US011496843B2

(12) United States Patent
Kvist et al.

(10) Patent No.: US 11,496,843 B2
(45) Date of Patent: Nov. 8, 2022

(54) HEARING DEVICE WITH ANTENNA EXTENDING FROM THE HEARING DEVICE

(71) Applicant: GN HEARING A/S, Ballerup (DK)

(72) Inventors: Soren Kvist, Vaerlose (DK); Nikolaj Peter Brunvoll Kammersgaard, Ballerup (DK); Alexandre Da Luz Pinto, Ballerup (DK); Shi Pu, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/544,040

(22) Filed: Aug. 19, 2019

(65) Prior Publication Data

US 2020/0107141 A1 Apr. 2, 2020

(30) Foreign Application Priority Data

Sep. 28, 2018 (EP) ..... 18197790

(51) Int. Cl.
*H04R 25/00* (2006.01)
*H01Q 1/27* (2006.01)
(Continued)

(52) U.S. Cl.
CPC ..... *H04R 25/554* (2013.01); *H01Q 1/273* (2013.01); *H01Q 1/48* (2013.01); *H01Q 9/00* (2013.01);
(Continued)

(58) Field of Classification Search
CPC ..... H04R 25/00; H04R 25/02; H04R 25/55; H04R 25/554; H04R 25/558; H04R 25/60;
(Continued)

(56) References Cited

U.S. PATENT DOCUMENTS 10,051,391 B2 8/2018 Henriksen
10,735,873 B2 * 8/2020 Adel ..... H04R 25/554
(Continued)

FOREIGN PATENT DOCUMENTS

EP 2088804 8/2009
EP 2088804 A1 * 8/2009 ..... H04R 25/554
(Continued)

OTHER PUBLICATIONS

The Electrical Engineering Handbook (Wai-Kai Chen, ed.; Elsevier, 2005) (Year: 2005).*
(Continued)

*Primary Examiner* — Walter F Briney, III
(74) *Attorney, Agent, or Firm* — Vista IP Law Group, LLP

(57) ABSTRACT

An in-the-ear hearing device includes: a microphone configured to receive an audio signal; a signal processor configured to process the audio signal for compensating a hearing loss; a wireless communication unit being connected to the signal processor; a feeding network; a hearing device shell accommodating the microphone and the signal processor; a face plate positioned at the hearing device shell; and an antenna for electromagnetic field emission and electromagnetic field reception, the antenna coupled with the wireless communications unit, wherein the antenna has a first end, and wherein the feeding network is configured to feed the antenna via the first end of the antenna; wherein the antenna extends through the face plate at a first position; at least a part of the antenna extending from the faceplate being arch-shaped; and wherein a second end of the antenna is an electrically open end, or is coupled to a ground potential.

31 Claims, 13 Drawing Sheets

(51) Int. Cl.
*H01Q 1/48* (2006.01)
*H01Q 9/00* (2006.01)

(52) U.S. Cl.
CPC ..... *H04R 25/604* (2013.01); *H04R 25/65* (2013.01); *H04R 25/552* (2013.01); *H04R 2225/025* (2013.01); *H04R 2225/51* (2013.01)

(58) Field of Classification Search
CPC .. H04R 25/609; H04R 25/65; H04R 2225/00; H04R 2225/023; H04R 2225/025; H04R 2225/51; H04R 2225/57; H04R 2225/67
See application file for complete search history.

(56) References Cited

U.S. PATENT DOCUMENTS

2010/0020994 A1* 1/2010 Christensen ..... H04R 25/554 381/315
2011/0299713 A1* 12/2011 Moller ..... H04R 25/60 381/328
2016/0381470 A1* 12/2016 Henriksen ..... H04R 25/554 381/315
2017/0359644 A1* 12/2017 Cramer ..... H04R 1/105
2018/0084351 A1* 3/2018 Polinske ..... H04R 25/554
2020/0077209 A1* 3/2020 Henriksen ..... H04B 1/0458
2020/0107142 A1* 4/2020 Nielsen ..... H04R 25/65

FOREIGN PATENT DOCUMENTS

WO WO 2018/024392 2/2018
WO WO-2018024392 A1 * 2/2018 ..... H04R 25/554

OTHER PUBLICATIONS

Inverted-F antenna, https://en.wikipedia.org/wiki/Inverted-F_antenna (last accessed Jan. 27, 2021) (Year: 2021).*
Extended European Search Report for EP Patent Appln. No. 18197790.1 dated Mar. 15, 2019.
"Feed Line," Wikipedia Article, dated Mar. 18, 2018.

* cited by examiner

HEARING DEVICE WITH ANTENNA EXTENDING FROM THE HEARING DEVICE

RELATED APPLICATION DATA

This application claims priority to, and the benefit of, European Patent Application No. 18197790.1 filed on Sep. 28, 2018. The entire disclosure of the above application is expressly incorporated by reference herein.

FIELD

The present disclosure relates to hearing devices for compensating a hearing loss of a user, particularly hearing devices having wireless communication capabilities and thus hearing devices comprising antennas for communication.

The present disclosure further relates to a hearing device comprising a hearing device shell, the shell comprising a microphone configured to receive sound, a processing unit configured to provide a processed audio signal for compensating for a hearing loss of a user, a wireless communication unit configured for wireless communication. The hearing device further comprises a faceplate and an antenna for emission and reception of an electromagnetic field, the antenna extending through the faceplate.

The hearing device may be used in a binaural hearing device system. During operation, the hearing device is worn in the ear of a user for alleviating a hearing loss of the user.

BACKGROUND

Hearing devices are very small and delicate devices and comprise many electronic and metallic components contained in a housing or shell small enough to fit in the ear canal of a human or be located behind the outer ear. The many electronic and metallic components in combination with the small size of the hearing device housing or shell impose high design constraints on radio frequency antennas to be used in hearing devices with wireless communication capabilities.

Moreover, the antenna in the hearing device must be designed to achieve a satisfactory performance despite these limitations and other narrow design constraints imposed by the size of the hearing device.

The developments within wireless technologies for hearing devices and the continuous efforts to make hearing devices smaller and more cost effective to manufacture has led to the use of flexible carriers incorporating one or more antennas in hearing devices.

Still further, in binaural hearing device systems, the requirements to the quality of the communication between the hearing devices in the binaural hearing device system are ever increasing, and include demands for low latency and low noise, increasing the requests for effective antennas in the hearing devices.

SUMMARY

It is an object to provide a hearing device with radio frequency (RF)-antenna functionality, such as Bluetooth, at low cost and low device complexity. It is also an object to improve the wireless communication capabilities, such as improved wireless communication capabilities between two hearing devices worn in or behind opposite ears of the user, and/or between a hearing device and an accessory device, such as a smart phone. The hearing devices may be configured for wireless communication in an ISM frequency band. The RF antenna functionality may be implemented for operation at a frequency of at least 400 MHz, such as at a frequency of between 800 MHz and 6 GHz.

Radio connectivity between hearing devices allows for advanced binaural signal processing when the important ear-to-ear (E2E) link is ensured. Furthermore, the hearing devices may be connected to a plethora of accessories, either body-worn or being placed in the user's proximity, and hence to the Internet as part of the so-called Internet-of-things (IoT). However, it is challenging but of key importance to ensure a stable E2E link. The 2.4 GHz ISM (Industrial, Scientific, Medical) band is preferred due to the presence of many harmonized standards for low-power communications, such as Bluetooth Low Energy (BLE) or ZigBee, its worldwide availability for industrial use, and the trade-off between power consumption and achievable range. The E2E link is particularly demanding in terms of requirements on the wearable antenna design and performance. In fact, to achieve a good on-body performance the antenna may exhibit optimal radiation efficiency, bandwidth, polarization, and radiation pattern, while the physical volume available for the design is extremely reduced, as most times space comes at a premium in wearable devices such as hearing devices, in particular in-the-ear (ITE) hearing devices. Furthermore, mass production and industrial design needs provide a desire that the antenna may also be low-profile, lightweight, and inexpensive to manufacture. The antenna polarization characteristic may be an important performance parameter. More overall constrains may also be relevant. In fact, antenna efficiency may be seriously jeopardized by the proximity of the antenna to the human head, as the body tissues have very high losses around 2.4 GHz due to their high water content. This may critically impact the overall performance given the magnitude of the drop-in efficiency and the fact that the hearing device radios operate in an ultra-low-power regime. Another issue threatening antenna efficiency may be the small volume available for the design, as this necessarily brings the antenna in close physical, hence, as well as electromagnetic, proximity of other parts of the device, with a strong likelihood of coupling to them. A large bandwidth is hard to achieve as well for an electrically small antenna (ESA) due to its fundamental limits. The bandwidth may cover at least the whole 2.4 GHz ISM band, but a larger bandwidth may help to compensate for the detuning of the antenna caused by the effects of the body, effects which varies across users.

In accordance with the present disclosure, the above-mentioned and other objects are obtained by the disclosed hearing device.

Disclosed is a hearing device. The hearing device comprises a microphone configured to receive sound. The hearing device comprises a processing unit configured to provide a processed audio signal for compensating for a hearing loss of a user. The hearing device comprises a wireless communication unit configured for wireless communication. The hearing device is an in-the-ear hearing device comprising a hearing device shell. The hearing device shell comprises a microphone configured to receive an audio signal, a signal processor configured to process the audio signal for compensating a hearing loss of a user, a wireless communication unit and a feeding network. The wireless communications unit is connected to the signal processor. The hearing device further comprises a faceplate positioned at the hearing device shell. The hearing device comprises an antenna for emission and reception of an electromagnetic field and being interconnected with the wireless communications unit. The antenna has a first end being fed from the feeding network. The antenna extends through the faceplate at a first position of the faceplate.

In some embodiments at least a part of the antenna extending from the faceplate is arch-shaped and a second end of the antenna is an open end, such as an electrically open end.

In some embodiments, a second end of the antenna is interconnected to a ground potential. In some embodiments, a second end of the antenna is interconnected to a ground potential through a controlled impedance.

In some embodiments a second end of the antenna is interconnected to the wireless communication unit. In some embodiments, the second end of the antenna extends through the faceplate through a second through-hole of the faceplate to interconnect with the wireless communication unit.

Particularly for in-the-ear hearing devices, the hearing device shell is often times custom made to account for different structures of the inner canal, meatus and/or concha among different people. Thus, a hearing device shell is typically made by taking impressions of a user's ear, and have a custom hearing device shell manufactured so as to fit in the ear of a user. After manufacturing of the hearing device shell, electronic hearing components are fit into an open end of the shell and the shell is closed by a faceplate. The faceplate may be fastened to the hearing device shell in any known way, e.g. by gluing, molding, press-fitting, etc. Typically, the faceplate is configured with battery door to provide access to a battery of the hearing device. The electronic hearing components includes for example the microphone, the signal processor, the wireless communication unit and the feeding network.

The hearing device comprises an antenna for emission and reception of an electromagnetic field and being interconnected with the wireless communications unit. Typically, the antenna is an electric antenna, and the antenna has a first end being fed from the feeding network. The feeding network is positioned within the hearing device shell while the antenna extends from the feeding network through the faceplate at a first position of the faceplate. In some embodiments, the faceplate comprises a through-hole at the first position to allow the antenna to extend through the faceplate. The faceplate has an inner side facing towards the hearing device shell and an outer side facing towards the surroundings.

In some embodiments, the feeding network provides a feed for the antenna at the faceplate.

In some embodiments, the second end of the antenna is interconnected to a ground potential, such as connected to a ground potential through a controlled impedance. The controlled impedance may comprise an inductor or a capacitor.

In some embodiments, the second end of the antenna is connected to the faceplate. In some embodiments, the second end of the antenna is connected to the faceplate without extending through the faceplate. In some embodiments, the second end of the antenna is connected to the faceplate at the outer side of the faceplate. In some embodiments, the second end of the antenna is interconnected to the faceplate at a second position of the faceplate.

In some embodiments, the second end of the antenna is interconnected to a ground potential at the faceplate, such as connected to a ground potential at the outer side of the faceplate.

In some embodiments, the part of the antenna extending from the faceplate has a first section extending from the first position along a first axis being parallel, such as substantially parallel, to an ear-to-ear axis of a user when the hearing device is positioned in the operational position in the ear of a user. In some embodiments, a first angle between the first axis and the ear-to-ear axis is less than 25°, such as less than 10°. The first angle may be zero. The first angle may be between 0° and 25°. The part of the antenna extending from the faceplate may have a second section. In some embodiments the second section is extending in a direction parallel to the faceplate, such as substantially parallel to the faceplate. In some embodiments, the second section extends in a direction along a second axis, the second axis forming a second angle with the faceplate, the second angle being less than 25°, such as less than 10°. The second angle may be between 0° and 25°.

In some embodiments, the second section of the antenna has a curvature different from zero. The second section may have concave shape. The second section may have a convex shape. The second section may have an arch-shape.

In some embodiments, the antenna further has a third section extending parallel to the first axis, such as substantially parallel to the first axis, and being interconnected with the faceplate at the second position of the faceplate. In some embodiments, parallel, such as substantial parallel, may imply that a third angle between the third section and the first axis is less than 25°, such as less than 10°. The third angle may be zero. The third angle may be between 0° and 25°.

In some embodiments, the part of the antenna extending from the faceplate is a ∪ formed shaped or an inverse ∪ formed shape ∩, a circular shape or an elliptical shape. In some embodiments the first section, the second section and third section of the antenna has a ∪ formed or inverse ∪ formed shape. In some embodiments the first section, the second section and third section of the antenna forms at least a part of a circular shape or an elliptical shape. It is envisaged that the antenna extending from the faceplate may have any shape and is not limited to the herein suggested shapes.

The feeding network comprises one or more electric components providing a feed for the antenna. In some embodiments, the feeding network is configured to provide a single ended feed. In some embodiments, the feeding network is configured to provide a differential feed.

In some embodiments, the feeding network provides impedance matching for the antenna. The impedance matching for the antenna may include matching the impedance of the wireless communication unit to the combined impedance of the antenna and feedline. In some embodiments, the feeding network comprises a balun. In some embodiments, the feeding network comprises one or more controlled impedances, including capacitors, inductors and/or transmission lines, configured to optimize antenna parameters including antenna impedance matching. In some embodiments, the feeding network may comprise an antenna matching network. The feeding network may comprise antenna matching components. The feeding network may comprise a feeding circuit configured to provide a feed for the antenna.

In some embodiments, the feeding network is located in the hearing device shell adjacent to the faceplate. It is an advantage of having the feeding network, and thus the feed for the antenna, provided adjacent the faceplate to allow for the part of the antenna extending between the feed and the through-hole of the faceplate to be as short as possible. Hereby, the length of the part of the antenna extending from the faceplate is maximized.

In some embodiments, a current in the antenna has a maximum in a section of the antenna extending from the feeding network. In some embodiments, a current in the antenna has a maximum proximate the first section of the antenna. In some embodiments, the current in the antenna is larger in the first section of the antenna than in the second section of the antenna.

In some embodiments the antenna is an electrical antenna. In some embodiments, the antenna is a monopole antenna. In some embodiments, the antenna is a resonant antenna, such as an antenna configured to emit an electromagnetic field in a wavelength range about a resonance frequency.

Typically, the length of the antenna is defined in relation to a wavelength A of the electromagnetic radiation to be emitted from and received by the hearing device when it is positioned at its intended operational position at the ear of a user. The hearing device is typically configured to emit and receive electromagnetic radiation within a specific frequency range or band. In some embodiments, the frequency band is provided so as to include a resonance frequency for the antenna elements. Typically, the length of the antenna elements are optimized for use within such specific frequency bands, such as in a band about, or extending from, a peak resonant frequency.

For an antenna to be resonant, the length of the resonating element in free air is selected to correspond to an odd multiple of a quarter-wavelength, $\lambda/4$, of a wavelength A of the electromagnetic radiation to be emitted from the hearing device.

Typically, the length of the antenna is selected to optimize the antenna for use at a specific frequency or within a specific frequency band, such as selected to provide an optimum resonance at a specific frequency, such as within a desired frequency band. Typically, the antenna is optimized for ISM bands, including cellular and WLAN bands, such as for GSM bands or WLAN bands.

The frequency band may be a frequency band comprising a frequency selected from the following frequencies, such as comprising 433 MHz, 800 MHz, 915 MHz, 1800 MHz, 2.4 GHz, 5.8 GHz, etc. Thus, the frequency band may be selected as an ISM band, such as a GSM band or a WLAN band comprising any one or more of these frequencies.

The hearing devices as disclosed herein may be configured for operation in an ISM frequency band. Preferably, the antenna is configured for operation at a frequency of at least 400 MHz, such as of at least 800 MHz, such as of at least 1 GHz, such as at a frequency between 1.5 GHz and 6 GHz, such as at a frequency between 1.5 GHz and 3 GHz such as at a frequency of 2.4 GHz. The antenna may be optimized for operation at a frequency of between 400 MHz and 6 GHz, such as between 400 MHz and 1 GHz, between 800 MHz and 1 GHz, between 800 MHz and 6 GHz, between 800 MHz and 3 GHz, etc.

However, it is envisaged that the hearing device as herein disclosed is not limited to operation in such a frequency band, and the hearing device may be configured for operation in any frequency band.

In some embodiments, the length of the antenna is a quarter of a wavelength A or any multiple thereof, A being the wavelength corresponding to the emitted electromagnetic field.

In some embodiments, the antenna forms part of a pull-out handle or a pull-out string. The pull-out handle may be anchored to the faceplate. In some embodiments, the antenna is provided within a pull-out handle. In some embodiments, the pull-out handle is provided in an electrically non-conductive material, such as plastic or nylon. In some embodiments, the antenna is embedded within the pull-out handle. In some embodiments, the pull-out handle comprises a tube shaped element, and the antenna being provided within the tube.

In some embodiments, the pull-out handle connects to the faceplate at the first position only. In some embodiments, a first end of the pull-out handle connects to the faceplate at the first position and a second end of the pull-out handle connects to the faceplate at the second position.

In some embodiments, the location of the first position and the second position of the faceplate are associated with the arrangement of the faceplate in the ear of a user. In some embodiments, the faceplate comprising the first position and the second position has an orientation so that the first position is located towards a front end, the front end being closer to the tragus of an ear of a user when the hearing device is positioned at the operational position in the ear of the user, than a back end of the faceplate. In some embodiments, the faceplate has an orientation so that the first position is located towards the tragus/front of the head/ear and the second position is located towards the back of the head/ear. In this way, the first end of the antenna is located closer to the tragus of the ear of a user than a second end of the antenna when the hearing device is positioned at the operational position in the ear of a user.

It is an advantage of having the first end of the antenna located towards the tragus of the ear, as it has been found by the present inventors that the antenna with this orientation becomes more efficient. It has been found that when the first end of the antenna is closer to the tragus/front end of the ear of a user, the antenna becomes more efficient. In some embodiments, the second end of the antenna is an open end generating an electric field being higher than the electric field being generated at the first end of the antenna. By providing the open end towards the back of the ear lower loss in the tissue of the ear has been experienced is further away from tissue of the ear.

In some embodiments, the wireless communication unit is placed at a printed circuit board. The printed circuit board is provided in the hearing device shell. The printed circuit board may form the ground plane of the antenna.

In some embodiments, the hearing device has a first module comprising the wireless communication unit, the signal processor and a printed circuit board, the wireless communication unit and the signal processor being provided at the printed circuit board in the hearing device shell. The hearing device has a second module comprising the microphone. The second module is positioned in the hearing device shell adjacent to the faceplate. In some embodiments, the second module is positioned outside the hearing device shell, for example in the helix of the ear of a user. In some embodiments at least one connecting wire, interconnecting the microphone in the second module and the signal processor of the first module, forms at least a part of the antenna.

In some embodiments, a distance between the first position and the second position on the faceplate is less than 10 mm, such as between 3 and 8 mm, such as preferably 4 mm.

In some embodiments, at least one point of the antenna is between 2 mm and 2 cm above the faceplate, such as between 5 mm and 15 mm above the faceplate, such as 8 mm above the faceplate, and wherein that at least one point is a highest point.

The hearing device may comprise a battery. The battery may be a flat battery, such as a button shaped battery. The battery may be circular. The battery may be a disk-shaped battery.

The hearing device may be any hearing device, such as a hearing device of the in-the-ear type, such as in-the-canal type, such as completely-in-the-canal type of hearing device, etc.

The hearing device comprises one or more wireless communications unit(s) configured for wireless data communication. Each of the one or more wireless communication units may comprise a transmitter, a receiver, a transmitter-receiver pair, such as a transceiver, a radio unit, etc. The one or more wireless communication units may be configured for communication using any protocol as known for a person skilled in the art, including Bluetooth, including Bluetooth Low Energy, Bluetooth Smart, etc., WLAN standards, manufacturer-specific protocols, such as tailored proximity antenna protocols, such as proprietary protocols, such as low-power wireless communication protocols, such as low-power wireless communication protocols, such as CSR mesh, etc., RF communication protocols, magnetic induction protocols, etc. The one or more wireless communication units may be configured for communication using same communication protocols, or same type of communication protocols, or the one or more wireless communication units may be configured for communication using different communication protocols.

The processing unit is configured for providing a processed audio signal. The term sound and/or the term acoustic output may be understood to be an audio signal. Thus, the microphone may be configured to receive sound or an audio signal. An output transducer or speaker/receiver may be configured to provide or transmit an acoustic output or a processed audio signal, such as the processed audio signal provided by the processing unit. The acoustic output or processed audio signal may be provided or transmitted to an ear of the user wearing the hearing device during use.

It will be appreciated that the speaker of a hearing device is also known in the art as a "receiver". The term speaker is used herein to avoid confusion with other hearing device components.

The present disclosure relates to different aspects including the hearing device described above and in the following, and corresponding hearing devices, binaural hearing devices, hearing devices, hearing devices, systems, methods, devices, uses and/or product means, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
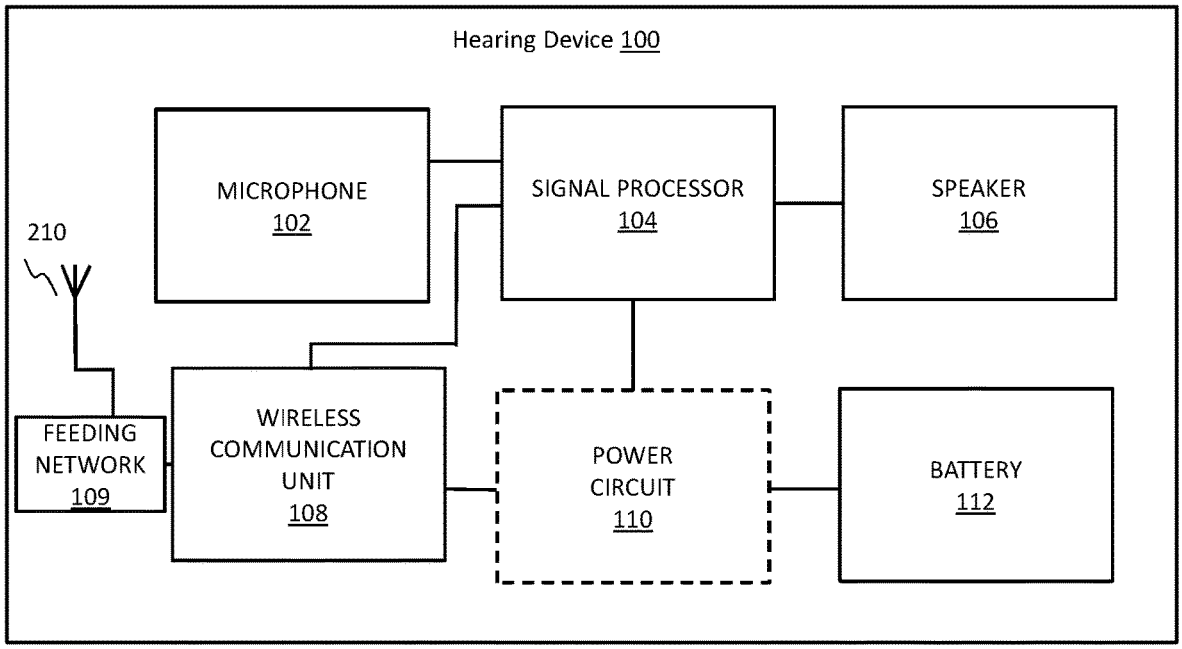
FIG. 1 schematically illustrates an example of components in hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

As used herein, the term "antenna" refers to an electrical device which converts electric power into radio waves. An electric antenna may comprise an electrically conductive material connected to e.g. a wireless communications unit, such as a radio chip, a receiver or a transmitter.

The claimed invention may be embodied in different forms and should not be construed as limited to the embodiments set forth herein.

A block-diagram of a typical hearing device 100 is shown in FIG. 1. The hearing device 100 comprises a first transducer, i.e. microphone 102, for receiving incoming sound and converting it into an audio signal, i.e. a first audio signal. The first audio signal is provided to a signal processor 104 for processing the first audio signal into a second audio signal compensating a hearing loss of a user of the hearing device 100. A receiver or speaker 106 is connected to an output of the signal processor 104 for converting the second audio signal into an output sound signal, e.g. a signal modified to compensate for a user's hearing impairment, and provides the output sound to the speaker 106.

The hearing device signal processor 104 comprises elements such as amplifiers, compressors and noise reduction systems etc. The hearing device may further have a filter function, such as compensation filter for optimizing the output signal. The hearing device may furthermore have a wireless communication unit 108, such as a wireless communication circuit, for wireless data communication interconnected with an antenna 210 for emission and reception of an electromagnetic field. The wireless communication unit 108, including a radio or a transceiver, connect to the hearing device signal processor 104 and the antenna 210, for communicating with external devices, or with another hearing device, such as another hearing device, located at another ear, typically in a binaural hearing device system. The hearing device 100 further comprises a power source 112, such as a battery. Furthermore, a power circuit 110 (optional) is provided for controlling the power provided from the battery 112 to the signal processor 104 and the wireless communication unit 108. A feeding network 109 is providing a feed for the antenna 210.

In some embodiments, the hearing device is an in-the-ear hearing device comprising a hearing device shell 200 and a faceplate 204. In some embodiments, the shell is hollow. In some embodiments, the hearing device shell is provided with an open end through which electronic hearing components are fitted into the hearing device shell 200. The open end of the shell is afterwards closed by a faceplate 204. The faceplate may be fastened to the hearing device shell in any known way, e.g. by gluing, molding, press-fitting, etc. Typically, the faceplate 204 is configured with battery door to provide access to a battery of the hearing device. The electronic hearing components includes for example the microphone 102, the signal processor 104, the speaker 106, the wireless communication unit 108 and the feeding network 109.

FIGS. 2*a*-2*d*, schematically illustrates exemplary antennas of a hearing device. The hearing device illustrated is an in-the-ear hearing device 100 having a hearing device shell 200 and a faceplate 204. The antenna 210 extends through the faceplate 204 at a first position 208 of the faceplate. The antenna 210 has a first end 206 being fed from the feeding network 109 at feed 205.

Figure 2A:
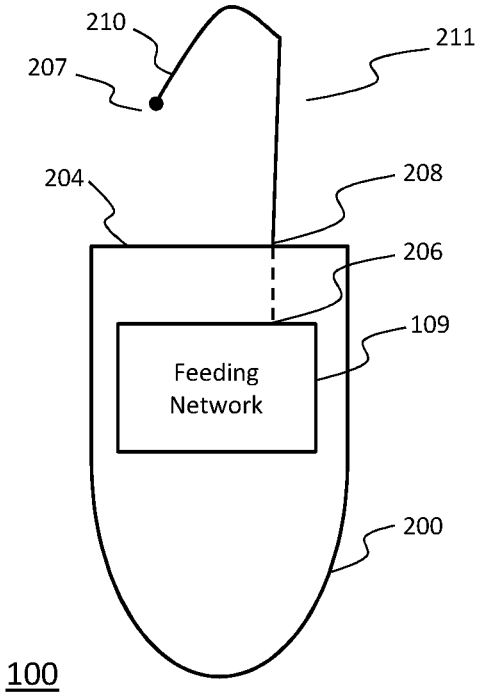
FIGS. 2*a*-2*d* schematically illustrates exemplary antennas for a hearing device.

In FIG. 2*a*, the antenna 210 extends from the faceplate 204 from first position 208 and the part of the antenna extending from the faceplate is marked with reference number 211. At least a part of the antenna extending from the faceplate 204 is arch-shaped and the second end 207 of the antenna 210 is an electrically open end.

Figure 2B:
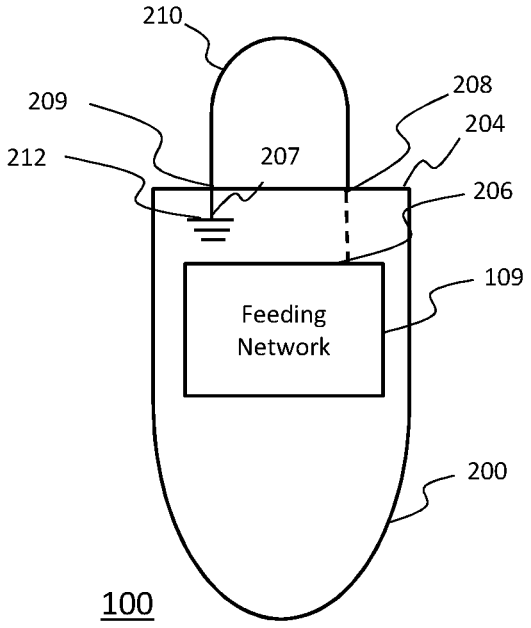

In FIG. 2*b*, the antenna 210 extends from the faceplate 204 from first position 208 and the part of the antenna extending from the faceplate is marked with reference number 211. The antenna 210 extends in a looped shape from the first position 208 of the faceplate to a second position 209 of the face plate, the antenna 210 has an interconnection to the faceplate 204 at the second position 209. The second end 207 of the antenna 210 is interconnected to a ground potential 212. The second end 207 of the antenna 210 may be interconnected to the ground potential 212 through a controlled impedance (not shown).

The ground potential 212 may be provided in the faceplate 204, so that the second end 207 of the antenna is not extending through the faceplate 204. In some embodiments, the ground potential 212 is provided in the hearing device shell 200, i.e. on the inside of the faceplate, and the antenna extends through the faceplate 204 at the second position 209 to connect with the ground potential 212.

Figure 2C:
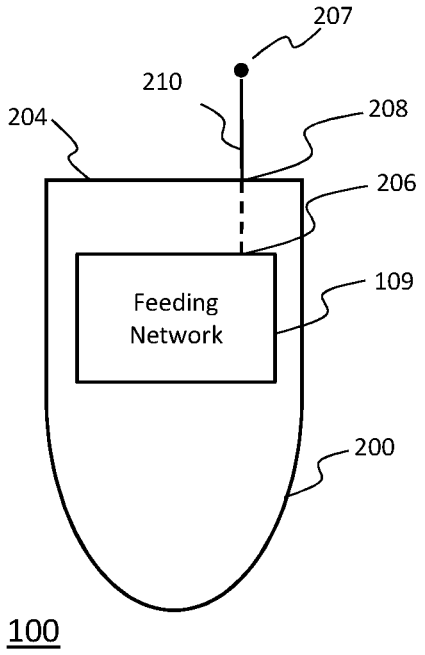

In FIG. 2*c*, the antenna 210 extends from the feed 205 through the faceplate 204 at first position 208 to the second end 207 of the antenna; at least the part of the antenna extending from the faceplate 204 has a rod shape; the second end 207 being an open end, i.e. an electrically open end.

Figure 2D:
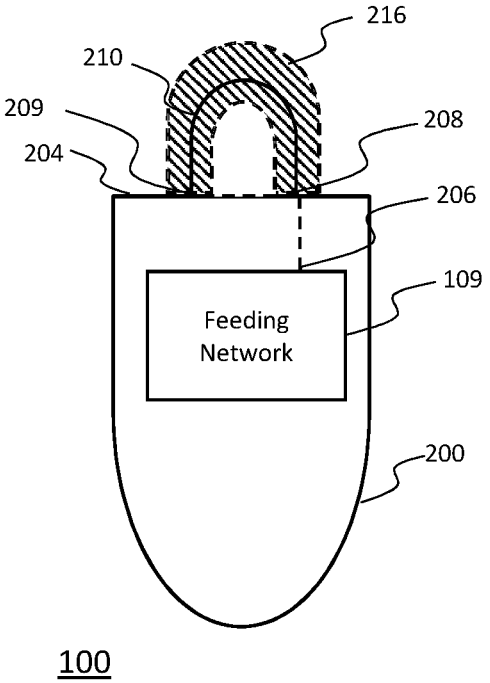

In FIG. 2*d*, the antenna extends from the feed 205 at the first end 206 of the antenna and the antenna extends through the faceplate 204 at the first position 208. The antenna forms a loop and interconnects with the faceplate at the second position 209. In FIG. 2*d*, a pull-out handle 216 is shown. The antenna 210 extends within the pull-out handle 216. In some examples, the pull-out handle 216 is a hollow tube, and e.g. made of nylon, and the antenna extends within the tube. However, it is envisaged that the pull-out handle may be made in any other way, and the antenna may extend within a hollow tubular pull-out handle, the antenna may be embedded within the material of the pull-out handle, etc.

FIGS. 3*a*-*d* schematically illustrates exemplary feeding networks for exemplary antennas. As set out above, the electronic hearing components including for example the microphone 102, the signal processor 104, the speaker 106, the wireless communication unit 108 and/or the feeding network 109 are provided in the hearing device shell (not shown in FIGS. 3*a*-*d*).

Figure 3A:
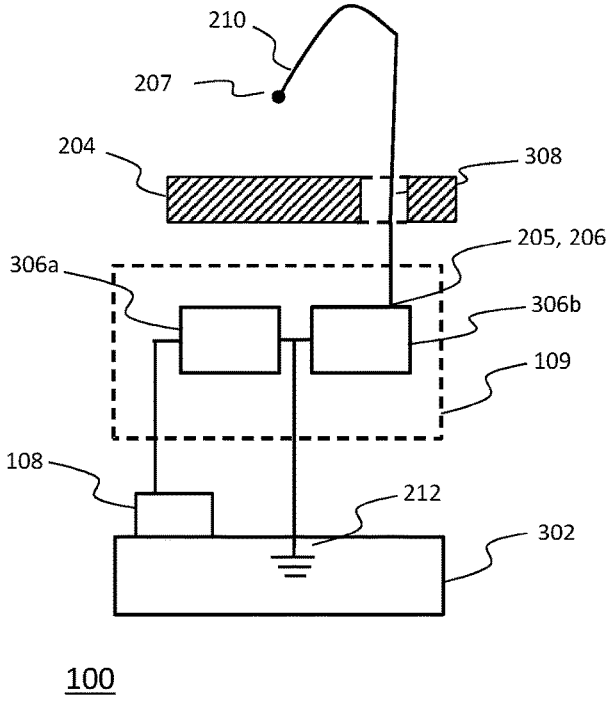
FIGS. 3*a*-3*d* schematically illustrates exemplary feeding networks for exemplary antennas.

The antenna illustrated in FIG. 3*a* corresponds to the antenna illustrated in FIG. 2*a*. The antenna 210 extends from the feed 205 through the faceplate 204 to the second end 207; the second end being an open end. The faceplate 204 has a through-hole 308 through which the antenna 210 extends. The antenna may be provided with any coating or cover (not shown) to make the antenna more robust and the antenna may be connected to the faceplate in any manner.

In FIGS. 3*a*-3*d*, the feeding network 109 is shown in more detail. As is seen, the antenna is fed from the feeding network, and the feeding network provides an interconnection between the antenna and the wireless communication unit. The interconnection is provided at the first end 206 of the antenna and/or at the second end 207 of the antenna. The interconnection between the antenna and the wireless communication unit is provided through one or more controlled impedances, the controlled impedances including capacitors, inductors and/or transmission lines. The controlled impedances are selected to design the RF current distribution of the antenna. The controlled impedances are configured to optimize antenna parameters, including antenna impedance matching. The wireless communication unit 108 is provided at printed circuit board 302. Typically, the printed circuit board 302 forms the ground plane for the antenna 210. In FIGS. 3*a*-*d* also the faceplate 204 is shown in more detail. The faceplate has one or more through-holes, including first through-hole 308 and possibly second through-hole 309. The antenna 210 extends from the feed 205 through the first through-hole 308 at the first position 208 of the faceplate 204. In some embodiments, the antenna extends through the faceplate 204 at the second position 209 through second through-hole 309. The second end 207 of the antenna may then connect to the feeding network 109 within the hearing device shell 200. In other embodiments, the second end 207 of the antenna is connected to the faceplate 204 with or without extending through the faceplate.

In FIG. 3*a*, the wireless communication unit 108, being positioned on a printed circuit board 302, is connected to a first controlled impedance 306*a*, the first controlled impedance is connected to a second controlled impedance 306*b* and further has a connection to ground potential 212. The first end 206 of the antenna is connected to the second controlled impedance 306*b* at 205 providing a feed for the antenna.

The feed in FIG. 3*a* is a single ended feed. The feeding network represents an inverted F-antenna. The second end 207 of the antenna is an open end.

Figure 3B:
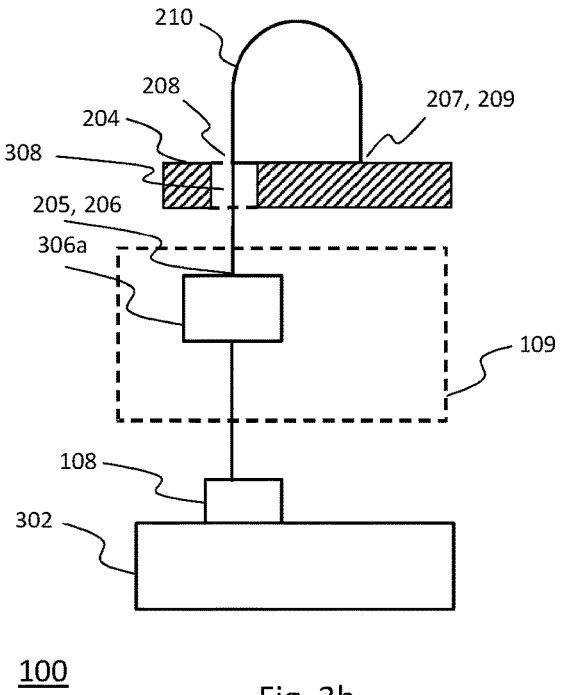

In FIG. 3*b*, the wireless communication unit is connected to the antenna through controlled impedance 306*a*. The antenna 210 is connected to the controlled impedance at the first end 206 at position 205 providing a feed for the antenna. The feeding network provides a monopole antenna. The second end 207 of the antenna is interconnected with the faceplate. It is an advantage of interconnecting the second end 207 of the antenna with the faceplate in that noise stemming from handling of the antenna or the pull-out handle comprising the antenna may be reduced.

In some embodiments, the second end 207 of the antenna may be connected to a ground potential (not shown).

Figure 3C:
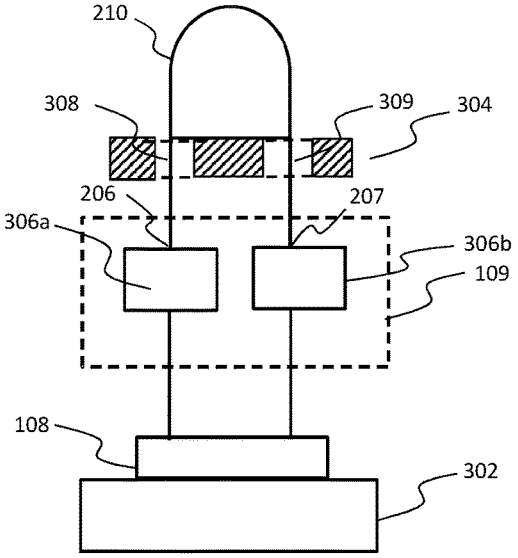

In FIG. 3*c*, a further embodiment is shown. The antenna 210 is interconnected with wireless communication unit 108 through feeding network 109. The first end 206 of the antenna 210 connects to the wireless communication unit 108 through controllable impedance 306*a*. The second end 207 of the antenna 210 connects to the wireless communication unit 108 through controllable impedance 306*b*. Thus, the antenna 210 forms a loop antenna with both the first end 206 and the second end 207 being interconnected with the wireless communication unit 108.

Figure 3D:
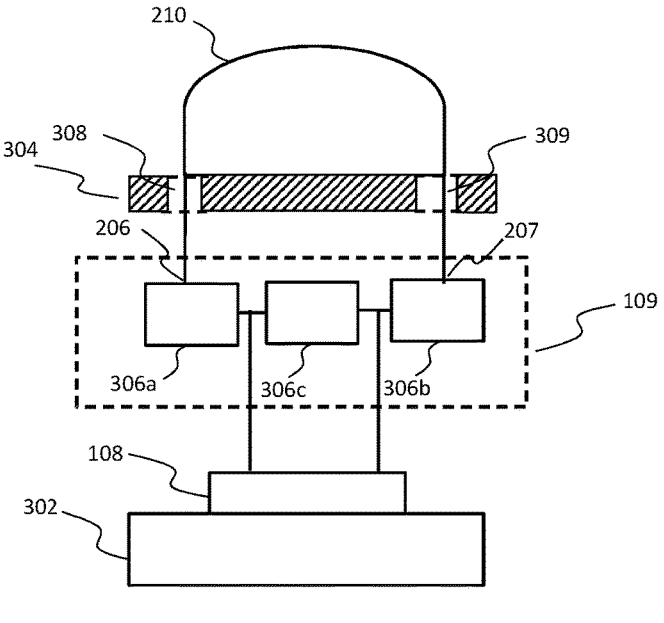

In FIG. 3*d*, a further embodiment is shown. The antenna 210 is interconnected with wireless communication unit 108 through feeding network 109. The first end 206 of the antenna connects to the wireless communication unit 108 through controllable impedance 306*a*. The second end 207 of the antenna connects to the wireless communication unit 108 through controllable impedance 306*b*. Thus, the antenna 210 forms a loop antenna with both the first end 206 and the second end 207 being interconnected with the wireless communication unit 108. A further controlled impedance 306*c* is provided between the first and second controlled impedances, 306*a*, 306*b*.

Figure 4A:
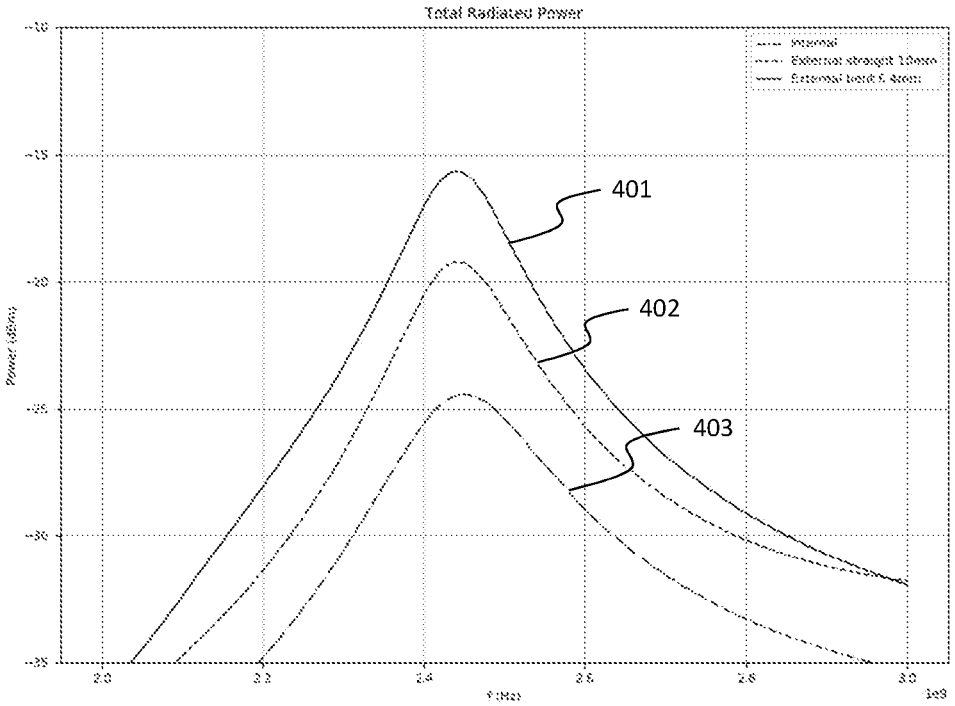
FIG. 4*a* shows total radiated power for an antenna of an embodiment of the disclosure.

In FIG. 4*a* total radiated power for an antenna of an embodiment of the disclosure is shown. The graph shows three different antenna configurations, internal antenna, external antenna being a straight wire having a length of 10 mm, and an external bent antenna, i.e. being arch-shaped having a length of 6.4 mm. The total radiated power (dBm) is measured over a frequency range of 2.0 GHz to 3.0 GHz. The measured total radiated power for the internal antenna is illustrated by curve 403, the total radiated power for the straight wire antenna is illustrated by curve 402, and the total radiated power for the bent wire antenna is illustrated by curve 401. It is seen that the bent wire antenna, even thought the total length is smaller than for the straight wire antenna, provides the highest total radiated power. This is a significant advantage and indicates that contrary to normal beliefs, a long straight wire antenna is not the optimum choice.

Figure 4B:
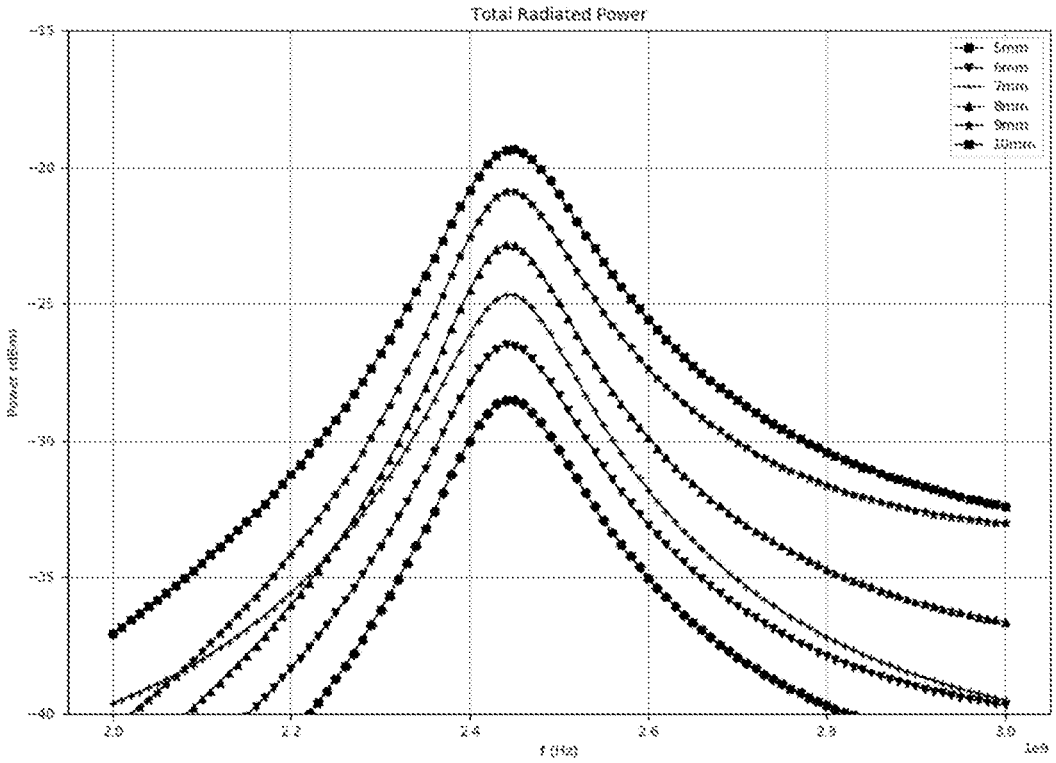
FIG. 4*b* shows total radiated power for antennas having different lengths.

FIG. 4*b* shows total radiated power for a straight wire antenna having different lengths above the faceplate measured as for FIG. 4*a*. It is seen that the longer the wire is the more radiated power may be provided, and that only with a length of 10 mm above the faceplate is the total radiated power above ~20 dBm.

Figure 5:
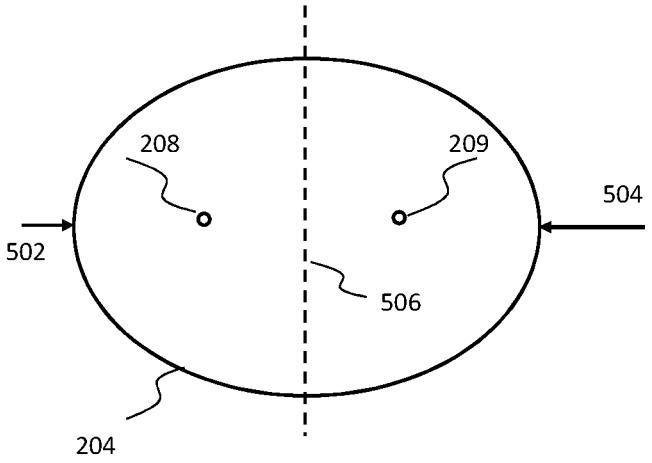
FIG. 5 show schematically a faceplate and the positioning of first and second positions.

FIG. 5 shows a top view of a faceplate 204. For illustrative purposes, the faceplate is presented as elliptical, however, it is envisaged that the faceplate may have any shape, including circular, elliptical, or any shape corresponding to the shape of the ear, when the hearing device is configured to extend into the concha of an ear.

In FIG. 5, the first position 208 and the second position 209 are illustrated. The location of the first position and the second position at the faceplate are associated with the arrangement of the faceplate in the ear of a user. The faceplate comprising the first position 208 and the second position 209 has an orientation so that the first position 208 is located towards a front end 502, the front end 502 being closer to the tragus of an ear of a user when the hearing device is positioned at the operational position in the ear of the user, than a back end of the faceplate. The faceplate has an orientation so that the first position 208 is located towards the tragus/front of the head/ear, i.e. towards front end 502, and the second position is located towards the back of the head/ear, i.e. towards a back end 504. In this way, the first end 206 of the antenna is located closer to the tragus of the ear of a user than the second end 207 of the antenna when the hearing device is positioned at the operational position in the ear of a user.

An intersection 506 is illustrated, the intersection 506 dividing the faceplate in a front end and a back end, typically along a center axis for the faceplate 204.

Figure 6:
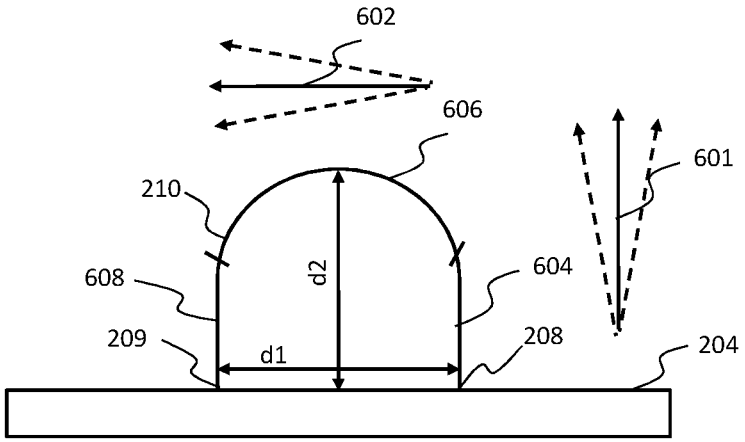
FIG. 6 show schematically dimensions of an antenna according to an embodiment of the present disclosure.

FIG. 6 illustrates the sizes of the antenna. The antenna 210 forms a loop, and the antenna 210 extends above the faceplate 204 from the first position 208 to the second position 209. A first section 604 of the antenna extends from the first position 208 along a first axis 601, the first axis forming a first angle with an ear-to-ear axis of a user when the hearing device is positioned in the operational position in the ear of a user, the first angle being less than 25°. The antenna has a second section 606 extending along a second axis 602, the second axis forming a second angle with the faceplate, the second angle being less than 25°. The antenna 210 further has a third section 608 extending parallel to the first axis and being interconnected with the faceplate 204 at the second position 209 of the faceplate.

The distance d1 between the first position 208 and the second position 209 is typically less than 10 mm, such as between 3 and 8 mm, such as 4 mm. The distance d2 from the faceplate 204 to a part of the antenna is between 2 mm and 2 cm, such as between 5 mm and 15 mm above the faceplate, such as 8 mm above the faceplate. The distance d2 may be measured between the faceplate and at least one point of the antenna 210, and at least one point is a highest point.

Figure 7A:
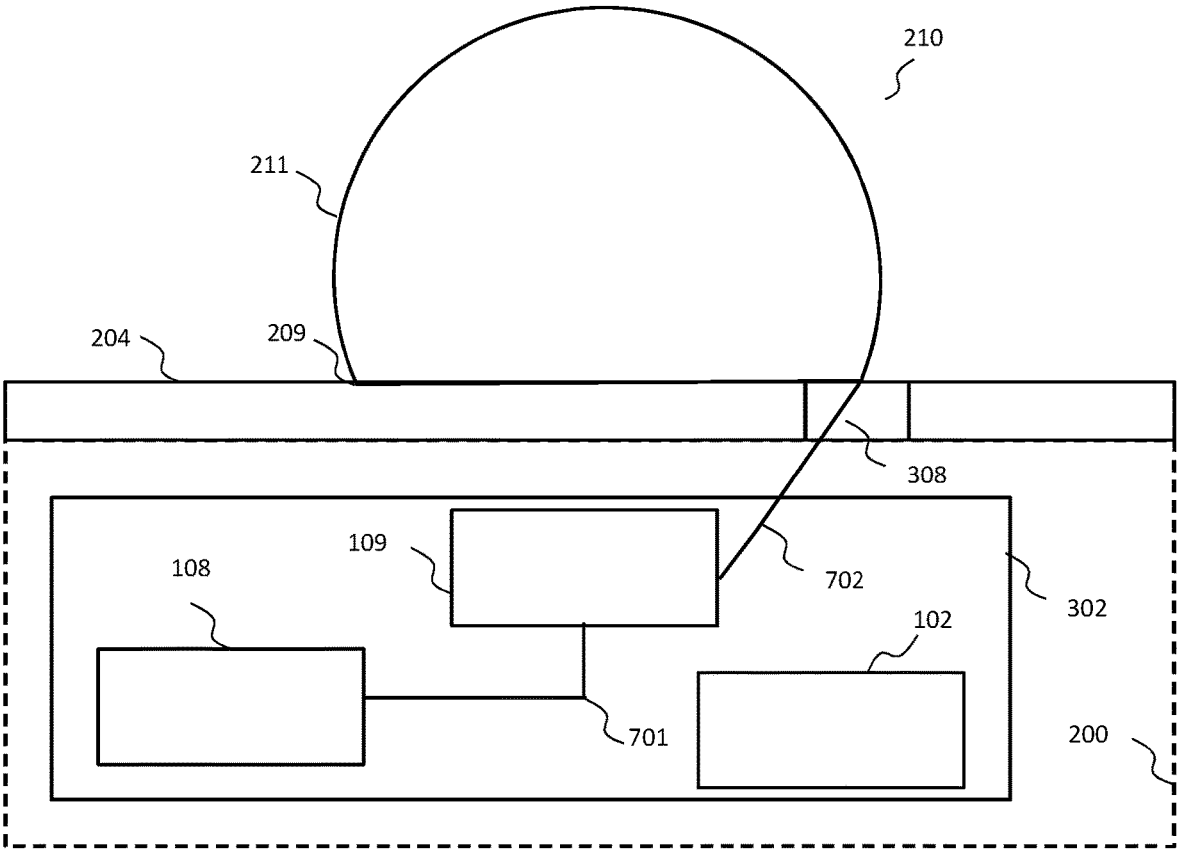
FIGS. 7*a*-7*b* schematically illustrates an example of a hearing device having an antenna, wherein the microphone is provided in the hearing device shell, and wherein the microphone is provided external of the hearing device shell, respectively.

FIG. 7*a* illustrates an example of a hearing device having an antenna 210, wherein the wireless communication unit 108, the feeding network 109 and the microphone 102 are positioned at a printed circuit board 302 inside the hearing device shell 200. A transmission line 701 interconnects the wireless communication unit 108 with the feeding network 109. The antenna 210 is fed from the feeding network 109 and the interior part 702 of the antenna 210 extends within the hearing device shell 200, through through-hole 308 in the faceplate 204 and the exterior part 211 of the antenna 210 extends above the faceplate, i.e. above the outer side of the faceplate.

Figure 7B:
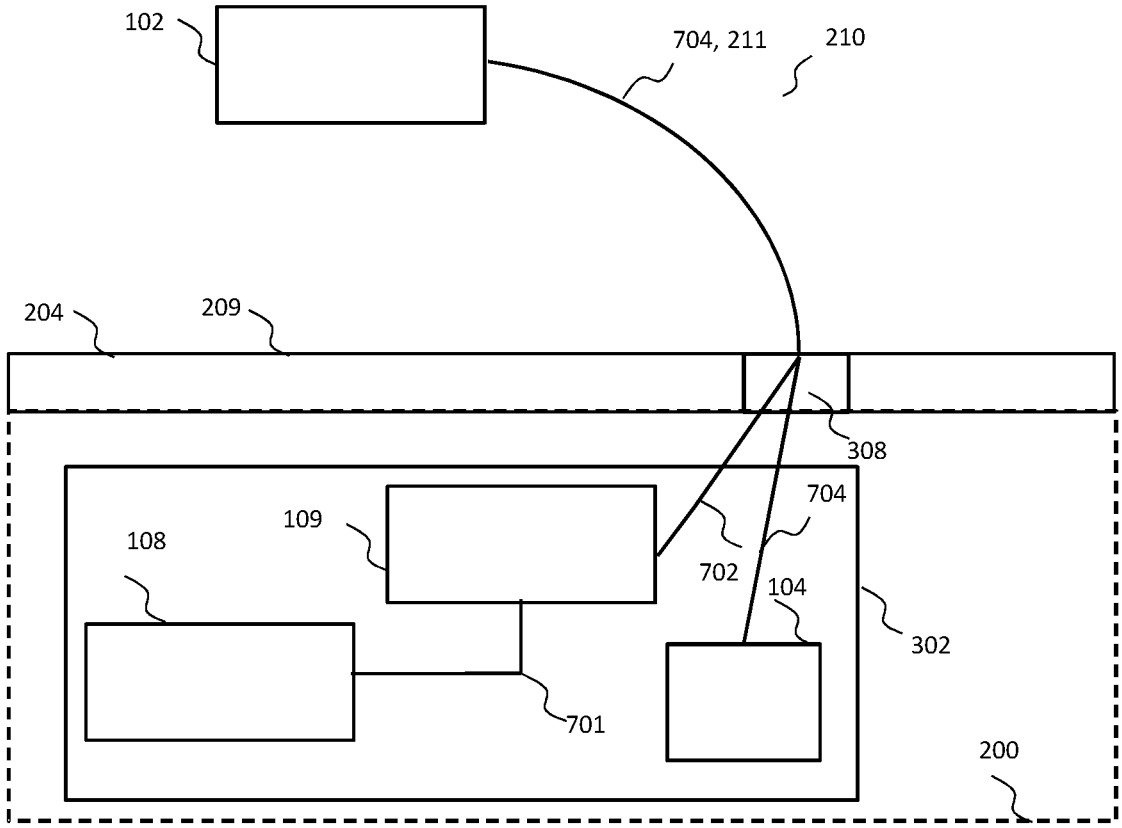

FIG. 7*b* illustrates an example of a hearing device having an antenna 210, wherein the wireless communication unit 108, the feeding network 109 and the signal processor 104 are positioned at a printed circuit board 302 inside the hearing device shell 200. In FIG. 7*b*, the microphone 102 are provided outside of the hearing device shell 200. The microphone 102 may for example be configured to be provided in the helix of the ear of the user. The hearing device may be of the microphone-in-the helix type. A transmission line 701 interconnects the wireless communication unit 108 with the feeding network 109. The antenna 210 is fed from the feeding network 109 and the interior part 702 of the antenna 210 extends within the hearing device shell 200, through through-hole 308 in the faceplate 204 and the exterior part 211 of the antenna 210 extends above the faceplate, i.e. above the outer side of the faceplate. The one or more microphones are interconnected with the signal processor 104 via signal line 704 including one or more conducting wires. In some embodiments, the signal line 704 and the antenna 210 may be provided in a same tube. In some embodiments, the signal line 704 may function also as the antenna 210. Thus, by re-using the signal line to function also as antenna 210, a separate conducting element functioning as antenna may be avoided. The signal line 704 may comprise the antenna 210, more specifically, the signal line 704 may comprises the exterior part 211 of the antenna, or the signal line 704 may comprise the interior part 702 of the antenna and the exterior part 211 of the antenna.

Figure 8A:
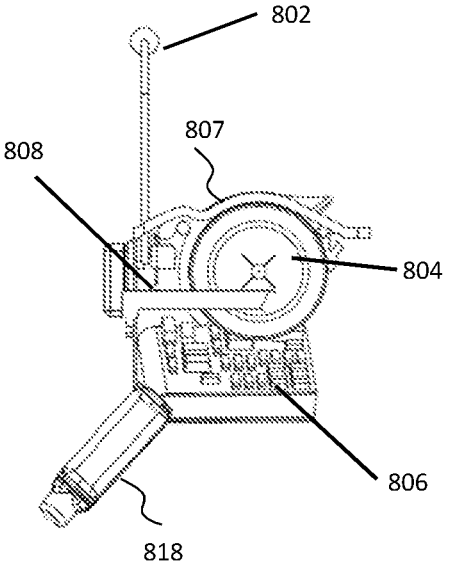
FIG. 8*a*-8*c* schematically illustrates a hearing device having a number of electric components provided in separate modules.
Figure 8B:
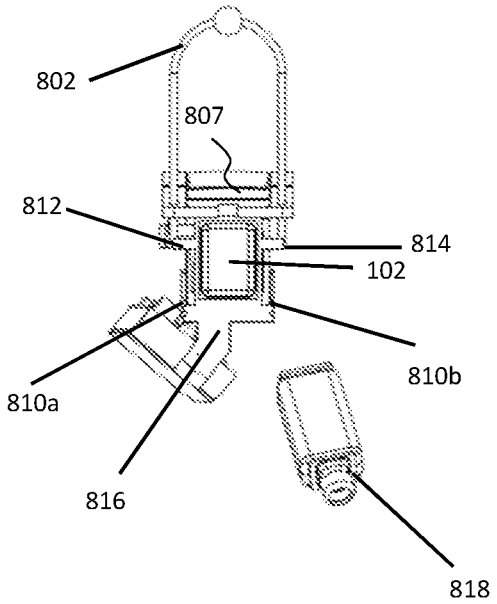
Figure 8C:
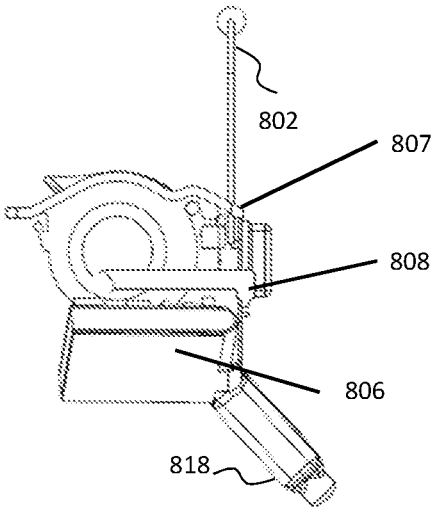

FIGS. 8*a*-8*c* illustrates a hearing device having electric components positioned in modules. The modular positioning of electric components within the hearing device enables a better noise control, as connecting wires etc. may be positioned between the modules in a controlled way.

In FIG. 8*a*, the hearing device comprises antenna 802, battery 804 and battery springs 808. The hybrid 806, comprises a number of electric components (not specified), the receiver or speaker 818 is provided extending from hybrid 806.

As seen in FIG. 8*b*, the receiver 818 is provided in a support, the support supporting both the hybrid 806 and the receiver 818. Microphones 801 are provided adjacent a faceplate 807. As seen a lid may be provided on top of the faceplate 807. Battery contact points 810*a*, 810*b* are provided for feeding power to the electric components. Antenna feed 812 is shown, and the second end connection 814 of the antenna 802 is connected to the hybrid 806 via printed circuit board 816.

FIG. 8*c* shows a third perspective of the hearing device. The antenna 802 is shown extending from faceplate 807. Receiver module 818 is seen below hybrid 806. The battery springs/connectors 808 are also shown. It is seen that the modular build provides a compact hearing device in which position of components may be well controlled.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

102 Microphone
104 Signal Processor
106 Speaker
108 Wireless communication unit (WCU)
109 Feeding Network
110 Power circuit
112 Battery
200 Hearing device shell
204 Faceplate
205 Feed
206 First end
207 Second end
208 First position
209 Second position
210 Antenna
211 exterior part of the antenna
212 Ground potential
216 Pull-out handle
302 Printed Circuit Board
306*a*, 306*b* and 306*c* controlled impedances
308 First through-hole
309 Second through-hole
401, 402, 403 curves
502 Front End
504 Back End
506 Intersection of faceplate
601 First axis
602 Second axis
604 First section
606 Second section
608 Third section
701 Transmission line
702 interior part of antenna
704 Microphone signal line
801 Microphones
802 Antenna
804 Battery
806 Hybrid
807 Faceplate
808 Battery Spring
810*a*, 810*b* Battery contact points
812 Antenna Feed on hybrid
814 Antenna connection to hybrid
816 Printed circuit board (flex or solid)
818 Receiver/Speaker

The invention claimed is:

1. An in-the-ear hearing device comprising:
a microphone configured to receive an audio signal;
a signal processor configured to process the audio signal for compensating a hearing loss of a user;
a wireless communication unit, the wireless communication unit being connected to the signal processor;
a feeding network;
a hearing device shell accommodating the microphone;
a face plate; and
an antenna for electromagnetic field emission and electromagnetic field reception, the antenna coupled with the wireless communication unit, wherein the antenna has a first end, and wherein the feeding network is configured to feed the antenna via the first end of the antenna;
wherein the antenna extends through the face plate at a first position on the faceplate;
wherein at least a part of the antenna extending from the faceplate is arch-shaped;
wherein a second end of the antenna is an electrically open end; and
wherein the electrically open end is closer to a back of an ear of the user than to a front of the ear when the hearing device is worn by the user.

2. The hearing device according to claim 1, wherein the second end of the antenna is coupled to the faceplate at a second position on the faceplate.

3. The hearing device according to claim 2, wherein a first section of the antenna extends from the first position along a first axis, the first axis forming a first angle with an ear-to-ear axis of the user when the hearing device is positioned in an operational position in an ear of the user, the first angle being less than 25°.

4. The hearing device according to claim 3, wherein the antenna has a second section extending along a second axis, the second axis forming a second angle with the faceplate, the second angle being less than 25°.

5. The hearing device according to claim 4, wherein the antenna further has a third section extending parallel to the first axis and being interconnected with the faceplate at the second position on the faceplate.

6. The hearing device according to claim 4, wherein the second section of the antenna is arch-shaped.

7. The hearing device according claim 3, wherein a current in the antenna has a maximum proximate the first section of the antenna.

8. The hearing device according to claim 1, wherein the feeding network is configured to provide a single ended feed or a differential feed.

9. The hearing device according to claim 1, wherein the feeding network is located side-by-side with respect to the faceplate.

10. The hearing device according to claim 1, wherein a length of the antenna is a quarter of a wavelength.

11. The hearing device according to claim 1, wherein the antenna forms at least a part of a pull-out handle, and wherein the pull-out handle is anchored to the faceplate.

12. The hearing device according to claim 1, wherein the first position is located towards a front end of the faceplate, and wherein a tragus of an ear of the user is closer to the front end than a back end of the faceplate when the hearing device is positioned at an operational position in the ear of the user.

13. The hearing device according to claim 1, wherein the antenna is a monopole antenna.

14. The hearing device according to claim 1, wherein the wireless communication unit is at a printed circuit board forming a ground plane of the antenna.

15. The hearing device according to claim 1, wherein a first module comprises the wireless communication unit, the signal processor and a printed circuit board, the wireless communication unit and the signal processor being at the printed circuit board; and wherein a second module comprises the microphone and is in the hearing device shell.

16. The hearing device according to claim 15, wherein at least a part of the antenna comprises a wire, the wire connecting the microphone in the second module and the signal processor in first module.

17. The hearing device according to claim 1, wherein a first part of the antenna extending from the faceplate has a U-shape, a circular shape, or an elliptical shape.

18. The hearing device according to claim 1, wherein the feeding network comprises one or more controlled impedances.

19. The hearing device according to claim 1, wherein the feeding network comprises capacitor(s), inductor(s), and/or transmission line(s).

20. The hearing device according to claim 1, wherein the feedback network is configured to improve an antenna impedance matching.

21. The hearing device according to claim 1, wherein the second end of the antenna is connected to the face plate via a connection, and wherein the second end of the antenna terminates at the connection.

22. The hearing device according to claim 1, wherein the second end of the antenna is connected to a connection that is directly below the face plate.

23. The hearing device according to claim 1, wherein the first end of the antenna is configured to generate a first electric field, the second end of the antenna is configured to generate a second electric field higher than the first electric field.

24. The hearing device according to claim 1, wherein a tragus of an ear of the user is closer to the first end of the antenna than to the second end of the antenna when the hearing device is positioned at an operational position in the ear of the user.

25. The hearing device according to claim 1, wherein a portion of the antenna that is closer to the electrically open end than to the first end of the antenna is contained in an electrically insulative material.

26. The hearing device according to claim 25, wherein the electrically insulative material is a part of a tubing that is configured to allow the hearing device to be pulled-out from an ear of the user.

27. The hearing device according to claim 26, wherein another portion of the antenna that is closer to the first end than to the second end of the antenna is contained in the tubing.

28. The hearing device according to claim 1, wherein the first end of the antenna is configured to provide a first electric field, and the second end of the antenna is configured to provide a second electric field that is higher than the first electric field.

29. The hearing device according to claim 1, wherein the face plate has a major surface facing the electrically open end of the antenna.

30. The hearing device according to claim 29, wherein the major surface of the face plate is configured to face an environment outside the user.

31. The hearing device according to claim 1, wherein the second end of the antenna is at the face plate.

* * * * *